US006602388B2

(12) United States Patent
Ruf et al.

(10) Patent No.: US 6,602,388 B2
(45) Date of Patent: Aug. 5, 2003

(54) PROCESS FOR FORMING HEADBOX FOR A MACHINE

(75) Inventors: Wolfgang Ruf, Herbrechtingen (DE); Hans Loser, Langenau (DE); Thomas Dietz, Königsbronn (DE); Klaus Lehleiter, Steinheim (DE); Konstantin Fenkl, Rammingen (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 10/238,614

(22) Filed: Sep. 11, 2002

(65) Prior Publication Data

US 2003/0005565 A1 Jan. 9, 2003

Related U.S. Application Data

(62) Division of application No. 09/589,893, filed on Jun. 9, 2000, now Pat. No. 6,471,828.

(30) Foreign Application Priority Data

Jun. 12, 1999 (DE) ..... 199 26 804

(51) Int. Cl.[7] ..... D21F 11/00; D21F 13/00

(52) U.S. Cl. ..... 162/123; 162/213; 162/336; 162/343; 29/17.3; 29/603.07

(58) Field of Search ..... 162/336, 343, 162/344, 345, 346, 339, 123, 212, 216, 218, 213; 29/17.1, 17.3, 603.07

(56) References Cited

U.S. PATENT DOCUMENTS

| | | | | |
|---|---|---|---|---|
| 4,221,635 A | | 9/1980 | Kurtz et al. | |
| 4,565,603 A | * | 1/1986 | Reiner et al. | 162/123 |
| 5,013,406 A | | 5/1991 | Hergert | |

* cited by examiner

*Primary Examiner*—Steven P. Griffin
*Assistant Examiner*—M. Halpern
(74) *Attorney, Agent, or Firm*—Greenblum & Bernstein, P.L.C.

(57) ABSTRACT

Process of forming a headbox for a machine, which includes arranging a plurality of headbox channels into rows and columns, positioning a lamella between adjacent rows, fixing an end of the lamella at a fixing point, and arranging lamellar supports downstream of, relative to a headbox flow direction, the fixing point.

10 Claims, 2 Drawing Sheets

PROCESS FOR FORMING HEADBOX FOR A MACHINE

CROSS-REFERENCE TO RELATED APPLICATIONS

The present application is a divisional application of U.S. patent application Ser. No. 09/589,893 filed Jun. 9, 2000 now U.S. Pat. No. 6,471,828 and claims priority under 35 U.S.C. §119 of German Patent Application No. 199 26 804.5 filed Jun. 12, 1999, the disclosures of which are expressly incorporated by reference herein in their entireties.

BACKGROUND OF THE INVENTION

1. Field of the Invention

The present invention relates to a process for forming a headbox for machine, e.g., a paper or cardboard machine, having a plurality channels arranged in attached rows and columns and at least one lamella arranged between two rows.

2. Discussion of Background Information

Headboxes with lamellae, similar to those discussed above, are generally known in the art. Viewed in the flow direction, these lamellae are arranged consecutively in channels generating turbulence.

Lamellae can be constructed as rigid formations that are designed to be articulated solely in their connection in the areas after the channels. Also, the lamellae to be flexible, which are rigidly clamped in the form of a cantilever between two rows of channels.

As long as the headbox is in operation, the lamellae are suspended in the suspension flow. However, if it is stopped, the free ends of the lamellae lean against the lower headbox wall, but stopping the headbox is also associated with a backflow of the suspension. This generates a suction effect on the lamellar surface, which results in a force that is very great due to the large surface of the lamella being impinged upon by negative pressure. This is considerably more dangerous for flexible lamellae than for rigid ones, because they are stressed especially greatly at their fixing points such that they can even break off.

SUMMARY OF THE INVENTION

The present invention provides a process for forming a headbox in which breaking of the flexible lamellae at the fixing points is substantially eliminated.

In particular, the headbox of the instant invention includes lamellar supports arranged after, with respect to a flow direction, the fixing point of the lamella.

The inventors of the instant invention recognized that the lamella had to be supported in the vicinity of its fixing point, but that there was a problem that the flow could not be obstructed by built-ins in the area of the headbox in which the lamellae are located.

Consequently, the present invention includes lamellar supports to be arranged in the areas of the bridges. These bridges are located between two columns of the channels. In terms of their width, the bridges are formed to adequately provide the required strength for the lamellar supports.

According to the invention, when viewed across a width of the paper machine, three lamellar supports can adequately support the lamella. For reasons of uniformity of flow of one row, it is recommended, however, for lamellar supports to be attached to all bridges.

So that the lamella is gradually conveyed from its fixing point towards its support line on the lower headbox wall, a curved shape can be advantageous for the lamellar support in the area of the lamellar bearing.

In addition, it is advantageous for reasons of symmetry related to flow technology if the section facing away from the lamellar support is provided with a substantially same curved shape.

It is especially advantageous for the transition from the fixing point of the lamella to the lamellar support to occur without a change in direction. The subsequent section of the lamellar support then has an optionally progressive curvature. As a result, the lamella is completely supported in a first section.

If several lamellae are present in a headbox, they are arranged at different height levels. In this way, a higher lamella is stressed more greatly in terms of bending, because the free end of this lamella has to bend more greatly in order to reach supporting lower headbox wall. Thus, different shapes of lamellar supports may be required, which could result in an increase in the diversity of parts and, therefore, in the costs for design, manufacturing, and storage. Further, the present invention can also utilize a uniform shape for the lamellar supports. In this regard, it is noted that the uniform shape of the lamellar support would have to be designed for the most unfavorable stress case.

In some applications, it can also be reasonable for almost exactly the optimal shape of a lamellar support to be selected for a row, which is the reason why the shape of lamellar supports that are situated higher has a greater curvature in this case than that of the lamellar supports that are situated lower.

Therefore, it is within the scope of the invention that both the same shape of the lamellar supports can be used simultaneously in a headbox in different row as well as different shapes in different rows.

A further aspect of the invention provides for the lamellar supports to be formed onto the bridges of the headbox while the channels are being manufactured. In this manner, expenses and costs can be reduced.

Further, it can be advantageous if:the lamellar supports can be mounted. This advantage exists if headboxes are supposed to be, e.g., retrofitted with lamellar supports.

If lamellar supports are being used only to support the lamellae, then all bridges may not be provided with lamellar supports. In some situations, this can produce a non-uniform flow of the suspension. Therefore, it can also be advantageous for lamellar supports to be present on the bridges not only to support the lamellae but also to influence the flow.

An advantageous alternative embodiment of the headbox can further provide that, when viewed in a vertical direction, the lamellae in the fixing point are spaced a distance from the lamellar supports. It may be preferable for such a distance to be, e.g., approximately 2 mm. In this design, there is a region in which a tapering gap is formed between the lamella and the support in the beginning areas of the lamellar support.

It is understood that the characteristics of the invention mentioned above and to be explained below can be used not just in the combinations provided, but also in other combinations or alone without departing from the scope of the invention.

The present invention is directed to a headbox for a machine. The headbox includes a plurality of channels arranged in rows that extend across a width of the machine and in columns substantially perpendicular to the rows, at least one lamella positioned between adjacent rows, a fixing point for the at least one lamella, and lamellar supports positioned after the fixing point, relative to a headbox flow.

According to a feature of the invention, the machine may include one of a paper and a cardboard machine.

In accordance with another feature of the invention, the bridges may be located between adjacent rows. The lamellar supports may be arranged on the bridges. Further, the lamellar supports can be integrally formed on the bridges and/or the lamellar supports may be coupled to the bridges.

According to still another feature of the present invention, the lamellar supports may include at least three lamellar supports which are arranged across a width of the headbox.

Further, the lamellar supports may be curved in a section arranged to face the at least one lamella. The lamellar supports can have a same curvature in a section arranged to face away from the at least one lamella as in the section arranged to face the at least one lamella.

In accordance with a further feature of the instant invention, with respect to the headbox flow direction, the lamellar supports may completely support the at least one lamella in a first section located directly after the fixing point.

According to a still further feature of the invention, each of the lamellar supports may have a same curvature shape.

In accordance with still another feature of the present invention, the lamellar supports of a first row can have a greater curvature than the lamellar supports of a second row which is located underneath the first row.

Moreover, bridges can be located between adjacent rows, and the lamellar supports may be coupled to bridges on which the at least one lamella is not supports. The lamellar supports may be coupled to bridges of an uppermost row.

The at least one lamella can be spaced a distance from the lamellar supports in a region of the fixing point. Further, the spaced distance can be approximately 2 mm.

According to another feature of the invention, the at least one lamella may be flexible lamella.

In accordance with still another feature of the present invention, the at least one lamella can include a plurality of lamellae. At least one lamella may be positioned between each adjacent row. The plurality of lamellae may be flexible lamellae.

According to another feature of the instant invention, bridges can be located between adjacent headbox channels in a same row, and the lamellar supports can be coupled to some of the bridges.

In accordance with a further feature of the invention, bridges can be located between adjacent headbox channels in a same row, and the lamellar supports may be coupled to all of the bridges.

The instant invention is directed to a process of forming a headbox for a machine. The process includes arranging a plurality of headbox channels into rows and columns, positioning a lamella between adjacent rows, fixing an end of the lamella at a fixing point, and arranging lamellar supports downstream of, relative to a headbox flow direction, the fixing point.

According to a feature of the instant invention, the process can also include locating bridges between adjacent headbox channels in a same row, and positioning the lamellar supports on at least some of the bridges. The lamellar supports may be positioned on at least three of the bridges. Further, the lamellar supports can be positioned on all of the bridges.

In accordance with another feature of the present invention, the lamella can be a flexible lamella.

Further, the process can further include positioning a lamella between each adjacent row, locating bridges between adjacent rows, and positioning the lamellar supports on at least some of the bridges. The lamellae may be flexible lamellae.

According to another feature of the present invention, the lamellar supports can have curved portions which are arranged to face the lamella.

In accordance with yet another feature of the instant invention, the process can include positioning a lamellar support on an uppermost row, such that the lamellar support of the uppermost row does not support a lamella.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
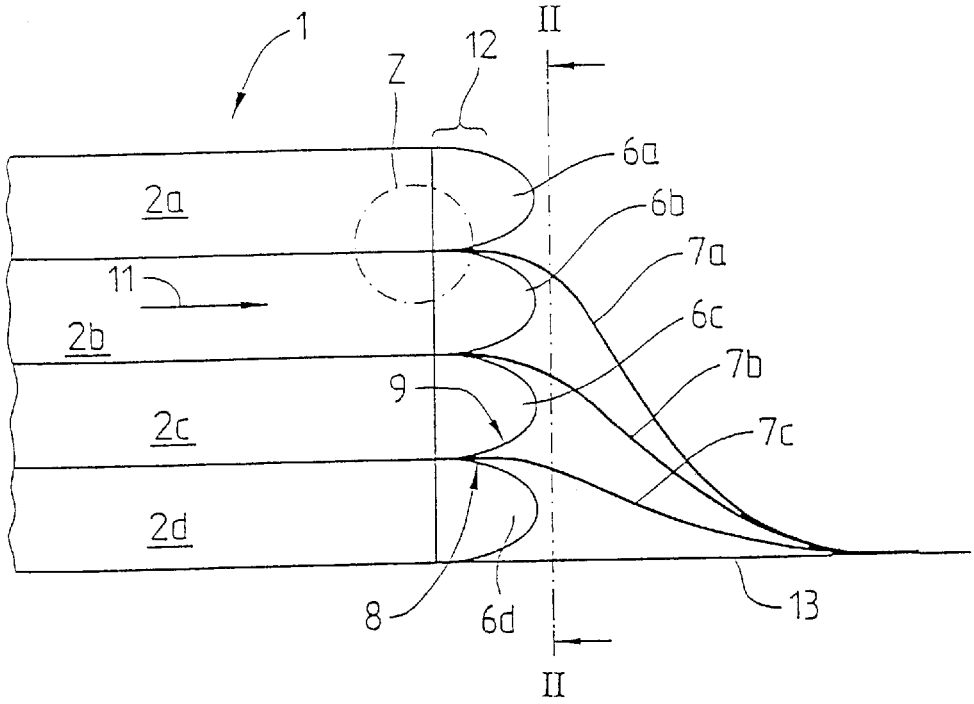
FIG. 1 illustrates a partial view of a cross-section through a headbox according to the invention.

FIG. 1 illustrates a headbox 1 in an idle state. When headbox 1 is in operation, a suspension flows through channels 2*a*, 2*b*, 2*c*, and 2*d* in a flow direction 11. Due to the idle state of headbox 1, the free ends of lamellae 7*a*, 7*b*, and 7*c* hang adjacent to a lower headbox wall 13. The lamellae can be formed to include, e.g., polycarbonate, Makrolon™. Lexan™. In a first section 12, lamellae 7*a*, 7*b*, and 7*c* are supported by lamellar supports 6*b*, 6*c*, and 6*d* in a section 8 facing lamellae 7*a*, 7*b*, and 7*c*, respectively. The lamellar supports, like the turbulence generator, can be formed to include, e.g., stainless steel. A section 9 of lamellar supports 6*b*, 6*c*, and 6*d* which are arranged opposite section 8, is formed as a mirror image to section 8. In the exemplary embodiment, lamellar support 6*a* can be used for the purpose of influencing flow.

Figure 2:
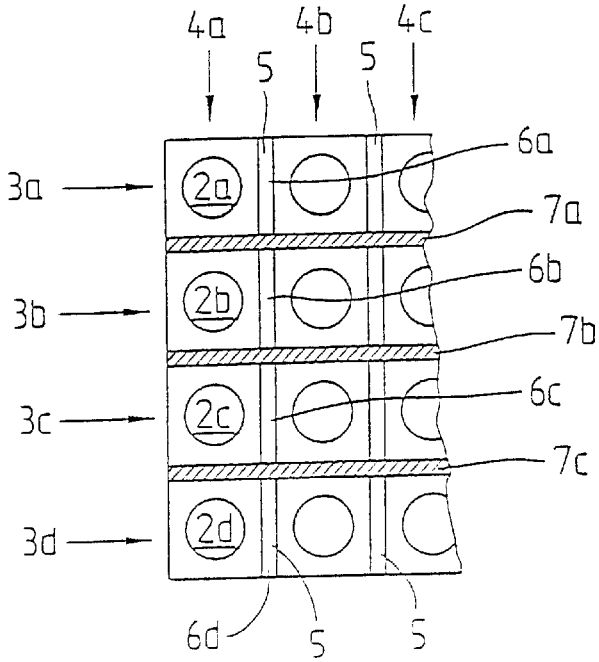
FIG. 2 illustrates Section II—II depicted in FIG. 1.

FIG. 2 illustrates an arrangement of channels 2*a*, 2*b*, 2*c*, and 2*d* into rows 3*a*, 3*b*, 3*c*, 3*d* and columns 4*a*, 4*b*, 4*c*, etc. Lamella 7*a*, e.g., is positioned between rows 3*a* and 3*b*; lamella 7*b*, e.g., is positioned between rows 3*b* and 3*c*; lamella 7*c*, e.g., is positioned between rows 3*c* and 3*d*. Bridge 5, which is located between columns 4*a* and 4*b* can also be utilized as a location for lamellar support 6*a*, 6*b*, 6*c*, and/or 6*d*. The bridges can be coupled to, e.g., welded to, or formed as part of the turbulence generator. Moreover, additional positioning possibilities for the lamellar supports are possible, but may also be cost-intensive.

Figure 3:
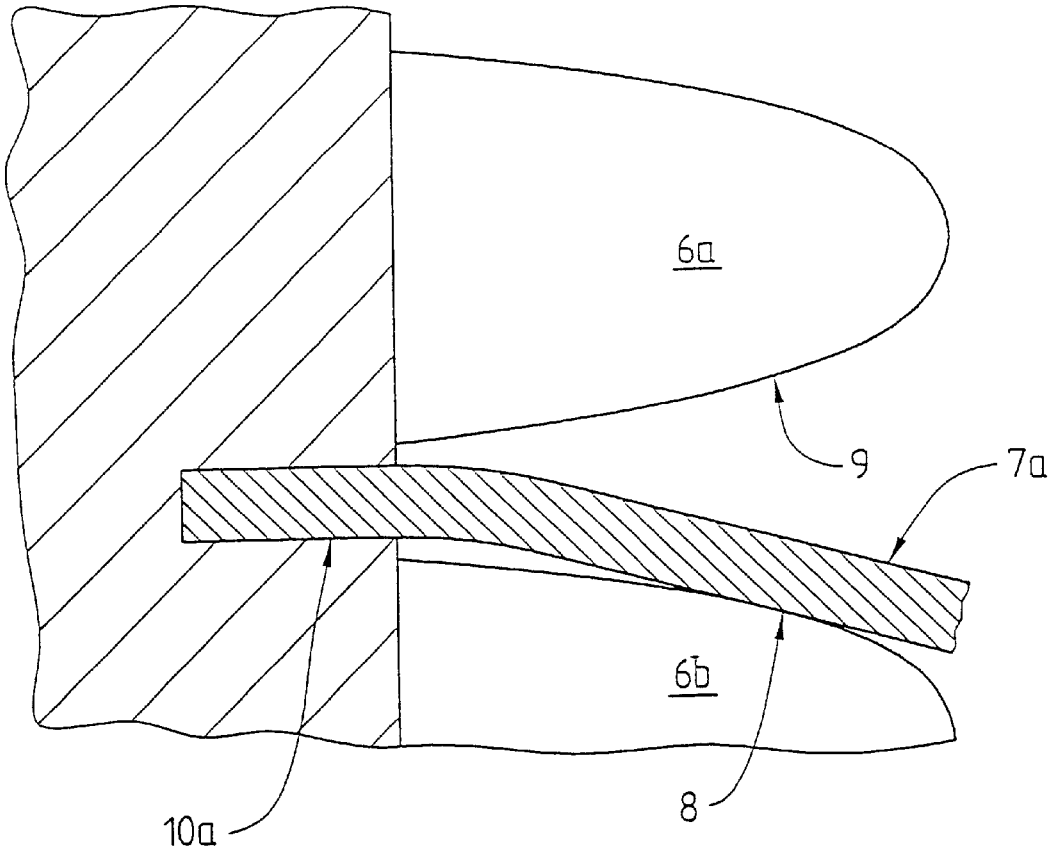
FIG. 3 illustrates detail Z depicted in FIG. 1.

A detail of section Z depicted in FIG. 1 is illustrated in FIG. 3, which shows the direct support area of lamella 7*a*. Lamella 7*a* is held at a fixing point 10*a* in the area of the channels, which, in this illustration, are not reproduced here. In this exemplary embodiment, there is a jump location or open region between section 8 of lamellar support 6*b* facing lamella 7*a* and fixing point 10*a*.

As shown, lamellar support 6*b* can be spaced a vertical distance from respective lamella 7*a* at fixing point 10*a*, thereby forming a tapering, free gap in flow direction 11 between lamella 7*a* and lamellar support 6*b* positioned underneath it. The vertical distance can be, e.g., approximately 2 mm.

As a result, lamella 7*a* first comes into contact with lamellar support 6*b* in a vicinity of an end area. Of course, for even further improved support of the lamellae, the jump location or open region can be eliminated. However, this change could results in additional manufacturing and assembly costs. Moreover, the support shown in the Figures is completely adequate and adequately reduces the tendency of the lamellae to break off.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| 1 | Headbox |
| 2a, 2b, 2c, 2d | Channel |
| 3a, 3b, 3c, 3d | Row |
| 4a, 4b, 4c | Column |
| 5 | Bridge |
| 6a, 6b, 6c, 6d | Lamellar support |
| 7a, 7b, 7c | Flexible lamella |

-continued

| | |
|---|---|
| 8 | Section facing the lamella |
| 9 | Section facing away from the lamella |
| 10a, 10b, 10c | Fixing point |
| 11 | Direction of flow |
| 12 | First section |
| 13 | Lower headbox wall |

What is claimed:

1. A process of forming a headbox for a machine comprising:

arranging a plurality of headbox channels into rows that extend across a width of the machine and columns substantially perpendicular to the rows;

positioning a lamella between adjacent rows;

fixing an end of the lamella at a fixing point; and arranging lamellar supports downstream of, relative to a headbox flow direction, the fixing point.

2. The process in accordance with claim 1, further comprising locating bridges between adjacent headbox channels in a same row, and positioning the lamellar supports on at least some of the bridges.

3. The process in accordance with claim 2, wherein the lamellar supports are positioned on at least three of the bridges.

4. The process in accordance with claim 2, wherein the lamellar supports are positioned on all of the bridges.

5. The process in accordance with claim 1, wherein the lamella is a flexible lamella.

6. The process in accordance with claim 1, further comprising positioning a lamella between each adjacent row;

locating bridges between adjacent rows; and positioning the lamellar supports on at least some of the bridges.

7. The process in accordance with claim 6, wherein the lamellae are flexible lamellae.

8. The process in accordance with claim 1, wherein the lamellar supports have curved portions which are arranged to face the lamella.

9. The process in accordance with claim 1, further comprising positioning a lamellar support on an uppermost row, wherein the lamellar support of the uppermost row does not support a lamella.

10. A process of forming a headbox for a machine comprising:

arranging a plurality of headbox channels into rows that extend across a width of the machine and columns substantially perpendicular to the rows;

positioning a lamella between adjacent rows;

fixing an end of the lamella at a fixing point; and supporting the lamella downstream of, relative to a headbox flow direction, the fixing point.

* * * * *